US008025106B2

(12) United States Patent
Schmidt

(10) Patent No.: US 8,025,106 B2
(45) Date of Patent: Sep. 27, 2011

(54) METHOD FOR TIGHTENING A SCREW CONNECTION AND SCREW DRIVING TOOL

(75) Inventor: Heiko Schmidt, Obersulm (DE)

(73) Assignee: Robert Bosch GmbH, Stuttgart (DE)

( * ) Notice: Subject to any disclaimer, the term of this patent is extended or adjusted under 35 U.S.C. 154(b) by 61 days.

(21) Appl. No.: 12/296,826

(22) PCT Filed: Mar. 24, 2007

(86) PCT No.: PCT/EP2007/002623

§ 371 (c)(1),
(2), (4) Date: Apr. 6, 2009

(87) PCT Pub. No.: WO2007/118577

PCT Pub. Date: Oct. 25, 2007

(65) Prior Publication Data

US 2010/0059240 A1 Mar. 11, 2010

(30) Foreign Application Priority Data

Apr. 12, 2006 (DE) ..... 10 2006 017 193

(51) Int. Cl.
*B25B 23/14* (2006.01)

(52) U.S. Cl. ..... 173/1; 173/2; 173/176; 173/181; 73/862.21

(58) Field of Classification Search ..... 173/1, 2, 173/5, 176, 178, 181, 183, 217; 81/467, 81/469; 318/432, 689; 73/761, 862.23, 862.21; 364/148, 474.16

See application file for complete search history.

(56) References Cited

U.S. PATENT DOCUMENTS 3,965,778 A 6/1976 Aspers et al.
5,131,130 A * 7/1992 Eshghy ..... 29/407.02
5,154,242 A * 10/1992 Soshin et al. ..... 173/178
5,215,270 A * 6/1993 Udocon et al. ..... 29/407.02
5,229,931 A * 7/1993 Takeshima et al. ..... 700/4
5,285,857 A * 2/1994 Shimada ..... 173/1
5,519,604 A 5/1996 Hansson
5,637,968 A * 6/1997 Kainec et al. ..... 318/432
6,134,973 A * 10/2000 Schoeps ..... 73/862.23
6,516,896 B1 * 2/2003 Bookshar et al. ..... 173/1
6,539,603 B1 * 4/2003 Bulow ..... 29/407.01
6,785,591 B1 * 8/2004 Hansson ..... 700/275
7,062,831 B2 * 6/2006 Walt et al. ..... 29/407.02

(Continued)

FOREIGN PATENT DOCUMENTS

DE 25 41 930 4/1976

(Continued)

*Primary Examiner* — Scott A. Smith
(74) *Attorney, Agent, or Firm* — Michael J. Striker

(57) ABSTRACT

Disclosed is a method for screwing in and tightening a screw connection (1) to a predetermined tightened level (2), especially a predetermined torque level (2) or a predetermined pretension level, with the aid of a hand-held screwing tool (3) comprising a regulated drive unit (4) and/or control functionality, particularly an electric nut runner (3). A tightening phase (B-C-D), during which the screw head rests against the supporting surface (6) of the screw connection (1), starts following a screwing phase (A). In order to improve said method, the speed (N) of the screwing tool (3) is increased to an output speed (7) for the tightening phase (B-C-D) within an acceleration time (8) in the tightening phase (B-C-D) and is lowered within a delay time (9) prior to or until reaching the predetermined tightened level (2). The combined acceleration time (8) and delay time (9) represents the predominant part of the entire tightening phase (B-C-D), especially in relation to the traveled angle of twist (W) of the screw connection (1), the acceleration time (8) being shorter than the delay time (9).

20 Claims, 3 Drawing Sheets

U.S. PATENT DOCUMENTS

| | | | | |
|---|---|---|---|---|
| 7,091,683 | B1 * | 8/2006 | Smith et al. | 318/432 |
| 7,138,785 | B2 * | 11/2006 | Brotto et al. | 320/106 |
| 7,234,536 | B2 | 6/2007 | Scholl et al. | |
| 2006/0032648 | A1 | 2/2006 | Scholl et al. | |

FOREIGN PATENT DOCUMENTS

| | | |
|---|---|---|
| DE | 690 20 994 | 4/1996 |
| DE | 694 26 958 | 10/2001 |
| DE | 698 07 090 | 5/2003 |
| DE | 103 48 427 | 5/2005 |
| DE | 10 2004 038 829 | 3/2006 |
| EP | 0 419 435 | 3/1991 |
| EP | 0 642 891 | 3/1995 |
| GB | 2 213 291 | 8/1989 |
| GB | 2 283 112 | 4/1995 |
| WO | 98/47665 | 10/1998 |

* cited by examiner

METHOD FOR TIGHTENING A SCREW CONNECTION AND SCREW DRIVING TOOL

CROSS-REFERENCE

The invention described and claimed hereinbelow is also described in PCT/EP2007/002623, filed on Mar. 24, 2007 and DE 10 2006 017 193.4, filed Apr. 12, 2006. This German Patent Application, whose subject matter is incorporated here by reference, provides the basis for a claim of priority of invention under 35 U.S.C. 119 (a)-(d).

BACKGROUND OF THE INVENTION

The invention relates to a method for tightening a screw connection to a predetermined tightening level and an electric screw driving tool.

In particular, a predetermined torque level or a predetermined prestressing force level is preset, which should be achieved after the tightening of the screw connection. This is achieved by using a hand-held screw driving tool with a regulated drive unit and/or control functionality, in particular an electric screwdriver. After a screwing-in phase, a tightening phase begins in which the screw head rests against the bearing surface of the screw connection.

According to the prior art, a separate drive unit regulator can be provided for this purpose, which adjusts the energy supply to the electric screwdriver and regulates its speed. A control unit is also used, which controls the speed, torque, rotation direction, and similar parameters until the screw driving procedure has achieved the predetermined torque level. Since no torque change or only a slight one occurs during the screwing-in phase, in which the screw is merely being screwed into the threaded hole and the screw head is not yet resting against the bearing surface of the screw connection, the speed during the screwing-in phase, for example, is practically constant. With the beginning of the tightening phase, the speed is as a rule reduced with such a method. It then remains virtually constant, practically until the achievement of the predetermined torque level. When the desired torque level is achieved, the control unit interrupts the energy supply from the drive unit regulator to the electric tool. The deactivation precision of the electric tool therefore depends on the reaction time of the system and on the shutoff lag time of the screw after the energy supply to the electric tool is switched off. The lower the tightening speed is, the less torque lag time there generally is; this will be discussed in greater detail later. Low speeds, however, have a negative impact on the duration of the process. Also, changes in the screw joint hardness that occur during the process (e.g. due to different screw batches and coefficients of friction/thread tolerances) are not taken into account in this method.

The disadvantage of the method mentioned at the beginning lies in the fact that due to the predetermined, static, and non-adaptive control unit behavior, the method is usually not flexible, for example with regard to various, alternating screw joint hardnesses; in addition, such a method is not very operator-friendly from an ergonomic standpoint.

SUMMARY OF THE INVENTION

The object of the present invention is to modify a method and an electric screw driving tool of the respective types mentioned at the beginning so that the method/the electric screw driving tool is flexible, particularly with regard to varying requirements such as different screw joints and/or different operator requirements (ergonomics).

The invention offers the advantage of an increased flexibility, particularly with regard to the quality of the screw connections produced and the duration of the screw driving procedure, and can also be ergonomically adapted in an operator-friendly fashion.

These advantages are achieved in that in the tightening phase, the speed of the screw driving tool is increased to a maximum speed within an acceleration interval and is slowed within a deceleration interval before or until the predetermined tightening level is achieved; the acceleration interval and the deceleration interval, taken together, make up the predominant portion of the total tightening phase, particularly with regard to the traveled rotation angle of the screw connection; in addition, the acceleration interval is shorter than the deceleration interval.

The acceleration interval or a quantity corresponding to it (e.g. a starting speed, a maximum speed, an instantaneous acceleration, or a limit acceleration) can be actively changed or be predetermined, controlled, and/or regulated; in particular, these values can be independent of individual or individually measured screw joint properties and do not have to be externally determined solely on the basis of system quantities such as maximum dynamics, etc.; this will be discussed in greater detail later.

The differentiation between the tightening phase and the screwing-in phase according to the invention is not strict. It is entirely conceivable for the method according to the invention, which is defined for the tightening phase, to extend at least partway into the screwing-in phase, i.e. the tightening phase according to the invention already begins during the screwing-in phase. The reverse of this also applies in corresponding fashion.

Furthermore, the invention is not absolutely limited to an increase in the speed, i.e. an angular acceleration of the screw of the screw connection, occurring exclusively within the acceleration interval; it is also not limited to a reduction in the speed, i.e. an angular deceleration of the screw connection, occurring exclusively within the deceleration interval. Instead, phases of practically unchanging speeds can occur during the acceleration interval and/or deceleration interval, phases with angular deceleration can occur during the acceleration interval, and/or phases with angular accelerations can occur during the deceleration interval. In this respect, the acceleration interval can also be referred to as the "$1^{st}$ phase" and the deceleration interval can also be referred to as the "$2^{nd}$ phase" and these terms can be used throughout the claims and the description of the invention.

In this connection, the deceleration interval and the acceleration interval are understood merely as schematic, qualitative indications in the sense that an acceleration and deceleration or essentially one acceleration and one deceleration take place during the respective interval.

Within the tightening phase, the speed of the screw driving tool—the speed at which the screw of the screw connection is turned—is increased to a maximum speed during the acceleration interval. The maximum speed is, in particular, predetermined, e.g. stored for a number of different screw connections in a predefined, retrievable fashion in a control unit, but in particular can also be flexibly—and in particular individually—determined for the individual screw connection. This will be discussed in greater detail later.

In this context, the expression "maximum speed" merely indicates an upper limit of the speed that can be individually established for the respective screw joint, but which can also be exceeded, for example to an insignificant degree.

The acceleration interval and the deceleration interval, taken together, make up the predominant portion of the total tightening phase. This can in particular relate to the traveled rotation angle of the screw connection. This is not limiting, however; thus it is also for the predominant portion to be understood in terms of time. According to the invention, the acceleration interval is shorter than the deceleration interval.

According to the invention, the quality of the screw driving procedure can be determined by the method according to the invention during the deceleration interval; this will be discussed in greater detail later. In any case, the deceleration interval, which makes up the greater portion of the total tightening phase, is essential for determining the quality of the resulting screw connection.

However, the invention has also recognized the importance of the acceleration interval; because of the fact that the acceleration interval is shorter than the deceleration interval, on the one hand, a certain freedom in the parameterization of the deceleration time is achieved and on the other hand, an adjustment of the quality and operator-friendliness of the screwdriver behavior is permitted.

Also, a rapid acceleration according to the invention (i.e. a short acceleration interval) tends to open up the possibility of using the inertia of the whole system to compensate for the accompanying rotation of the screwdriver—which is unpleasant to an operator such as a worker—when a torque is exerted on the screw connection, against which rotation the worker must brace with his or her muscle power or a "holding force". This will also be discussed in greater detail later.

The invention makes use of the inherent inertia of the system in order to make screw driving procedures more pleasant and in particular, more operator-friendly.

The above-mentioned advantages offered by the invention are used to improve the operator-friendliness in an efficient way if a time portion of the acceleration interval, which extends from the beginning of the acceleration to the achievement of between 20% and under 100% of the starting speed or corresponds to the entire acceleration interval, is shorter than a usual human reaction time—in particular that of an operator of average skill—required to compensate for and/or absorb the reaction force acting on the operator so that during the time portion, the reaction moment is essentially braced against by means of a reaction acceleration of the mass of the inertially encumbered screw driving tool, in particular also by additionally taking into account an in particular average inertially encumbered holding hand and/or an in particular average inertially encumbered holding arm. The time portion can amount to between 20 and 100% of the time extending from the beginning of the acceleration to the achievement of the starting speed. If the time portion amounts, for example, to less than 100% of the above-mentioned time, it is nevertheless possible for a significant portion of the acceleration to the starting speed to have already taken place; in other words, within this time portion, the essential portion of the acceleration is already braced against by the inertia of the screw driving tool and/or the holding hand and/or the holding arm.

The acceleration occurs so rapidly that the reaction force to which the operator is subjected within the usual human reaction times cannot be counteracted by the operator or can only be counteracted to an extent that is slight to negligible; as a result, the reaction acceleration deflects the screw driving tool, for example—in particular carrying the holding hand and/or holding arm along with it—by five to thirty degrees before the operator can correspondingly brace against by the reaction force. As a result, the reaction force acting on the operator is consequently braced against the inertia of the above-mentioned components themselves. The operator is practically unaffected by the reaction force or feels it only slightly. This makes handling and working with the method according to the invention and an electric screw driving tool according to the invention very operator-friendly and even pleasant, even in an industrial application in which a large number of screw connections are tightened per work shift.

The above-mentioned time portion particularly amounts to 20 to 200 ms, in particular 50 to 150 ms, and even more particularly 70 to 100 ms, and preferably 80 to 85 ms. The intervals mentioned, in particular their upper limits, assure that the desired acceleration is essentially achieved within an interval that is shorter than the usual human reaction time during which it is possible to brace against a corresponding reaction force. Their lower limits in particular assure that the drive dynamics on the one hand, are not overtaxed and on the other hand, are made use of efficiently. The lower limits of the above-mentioned intervals (i.e. the upper limits of the respective acceleration) are limited by the drive dynamics, for example, and are (pre-)parameterized within the dynamic power limits.

The method according to the invention can very flexibly open up additional possibilities for optimizing the quality of the screw connection on the one hand and the user-friendliness on the other if a torque curve that is practically characteristic for the screw connection and that is essentially described by the screw joint hardness is present during the tightening phase and if the screw joint hardness is determined in a starting phase of the tightening phase through measurement of at least one measurement quantity that is relevant to the screw joint hardness, for which purpose during the starting phase, a speed is set, which is reduced in comparison to an in particular average speed during the screwing-in phase. This embodiment therefore has a double benefit. The screw joint hardness can be determined in parallel with the execution of the method according to the invention, i.e. during the acceleration interval and/or deceleration interval; this can, however, also be carried out before the method is carried out (in particular chronologically before it is carried out); in this case, a measurement phase during which, for example, a measurement of a measurement quantity, which can be used (even predictively) for the torque curve, is carried out directly or indirectly prior to the method according to the invention, chronologically speaking.

Whereas during the screwing-in phase, a relatively high speed occurs (since a low to infinitesimal torque resistance is present), in the starting phase, this speed of the screwing-in phase must in particular be reduced, in fact to the extent that on the one hand, a reliable measurement can take place and on the other hand, the screw connection is tightened only slightly during the measurement phase that takes place, for example, during the starting phase of the tightening phase. The portion of the traveled rotation angle, which is controlled through the use of the measured screw joint hardness, can therefore be increased since during the measurement phase, the measurement result is not yet fully present and consequently, this measurement result may possibly not yet be used for controlling the screwdriver during the measurement itself.

The determined screw joint hardness or an evaluation quantity that corresponds to the screw joint hardness can, for example, be used for a statistical evaluation of a large number of screw connections for the sake of the quality monitoring and quality assurance in that, for example, the quality of each individual screw connection is documented by means of curves (e.g. torque curves) that are detected in an online fashion and are stored in memory. In addition, the screw joint hardness can also be used in order to adapt and/or define parameters that were determined before the tightening phase and which are decisive for the curve of the tightening phase, for the sake of an optimization with regard to the operator-friendliness and/or the quality of the screw connections (process duration, process precision, ergonomics, . . . ).

This will be discussed in greater detail below:

The screw joint hardness or an evaluation quantity that corresponds to it permits an individual optimization of the screw driving procedure in the above-mentioned sense with a low degree of complexity if the screw joint hardness is used during an—even indirect—determination of the acceleration interval and/or deceleration interval and/or starting speed. At a high screw joint hardness, the starting speed to be selected tends to be lower since at a high screw joint hardness and with the same amount of continuing rotation, a larger torque increase occurs in comparison to a low screw joint hardness (soft connections). Correspondingly, with a low screw joint hardness, the starting speed can be selected to be higher in order to accelerate the work or to avoid boredom when working with the invention. As another determinant, the predetermined tightening level may possibly also contribute to the determination of the acceleration interval and/or deceleration interval and/or starting speed.

When the screw joint hardness is used for optimizing the method during the tightening phase, it is possible to carry out an individual optimization for each individual screw connection to be tightened, while maintaining a high degree of operator-friendliness and good quality. In particular, the use of the screw joint hardness to determine or influence the progress of the method according to the invention has a markedly predictive character and can be used in a correspondingly advantageous fashion.

The comparatively simple determination of the screw joint hardness yields a high quality, predictive possible use, accompanied by a low measurement and calculation complexity, with the method being very simple, while at the same time being very precise and high-quality due to its predictive character.

Due to the inertia of the involved components, it is possible that upon achievement of a predetermined target torque (in accordance with the desired tightening level), the screw continues to rotate even after the drive unit of the screwdriver is switched off; this effect can be referred to as torque lag time. In order to reduce or approach preventing the torque lag time, which tends to be disadvantageous, according to one proposal of the invention, the screw joint hardness is used in an—even indirect—determination of the curve of the deceleration for the sake of avoiding or minimizing a torque lag time after the achievement of the desired tightening level.

In particular, if the starting speed represents a maximum speed, it is possible, based on the starting speed and through the use of the (in particular predictively relevant) screw joint hardness, to regulate and/or predetermine and/or precalculate the curve of the speed deceleration. The screw joint hardness or an evaluation quantity that corresponds to it is then a parameter, for example, for determining the deceleration curve of the speed. Particularly before the achievement of the predetermined tightening level or upon achievement of the predetermined tightening level, the speed is then preferably regulated downward until no torque lag time or only a slight to irrelevant torque lag time occurs.

A stable deceleration curve with a low to infinitesimal torque lag time can be achieved by using a PI regulating system to set the predetermined tightening level; the screw joint hardness is used in an automatic parameterization of the PI regulating system. This yields a characteristic PI behavior, which reduces the speed in an essentially degressive fashion and permits a smooth to steady transition to a minimum speed and has a low to infinitesimal torque lag time.

A simple and reliable sampling method, which furnishes sufficiently precise and reliable results even for a predictive use of the resulting screw joint hardness, is composed of detecting an instantaneous torque and an instantaneous rotation angle during the starting phase, in particular at two different times, and based on this, determining an evaluation quantity, which represents the screw joint hardness and is used according to claims 5 through 8 as the screw joint hardness. The instantaneous screw joint hardness can be differentially expressed, for example represented by the following evaluation quantity:

$$h_{diff} = \frac{dM}{dW},$$

where $H_{diff}$ is the differential (instantaneous) screw joint hardness or its evaluation quantity M is the moment (torque), and W is the angle.

The evaluation quantity for the instantaneous screw joint hardness can be determined in a directly differential fashion, e.g. through continuous differentiation of the torque curve in accordance with the angle curve. An even simpler and simultaneously reliable method, however, is composed of detecting the instantaneous torque and the instantaneous rotation angle at different times, preferably two of them, and based on this, determining an evaluation quantity that represents the screw joint hardness, for example as follows:

$$h = \frac{(M_2 - M_1)}{(W_2 - W_1)},$$

where h is the screw joint hardness or its evaluation quantity, $M_1$, $M_2$ are the moments (torques) at the two different times $t_1$, $t_2$, where $t_2 > t_1$, and $W_1$, $W_2$ are the angles at the two different times $t_1$, $t_2$ mentioned above.

In order on the one hand to permit an increased precision in the determination of the screw joint hardness and on the other hand, to prevent an uncontrolled or excessive continued rotation or an uncontrolled or excessive increase in the torque during the sampling phase, it is possible during the starting phase of the tightening phase, for a speed, in particular a constant speed, to occur that is reduced in comparison to the speed during the screwing-in phase; the resulting torque during the starting phase increases in a monotonous fashion, particularly in a very monotonous fashion. The starting phase mentioned here does not have to be identical to the starting phase referred to in claims 5 through 9; preferably, however, it largely corresponds to this starting phase so that the entire sampling occurs at the correspondingly reduced speed. The monotonous—and in particular at least in part very monotonous—increase assures that the moments measured can also represent the screw joint hardness—in particular through the above-mentioned averaging—for the individual screw joint over the course of the tightening phase.

A reliable regulation and in particular, a reproducible behavior during the screw driving procedure is achieved if a deceleration to a predetermined minimum speed takes place within the deceleration interval, which minimum speed is retrievably stored particularly in a control unit or drive unit of the screw driving tool.

The method has an adaptive tendency and can therefore be used statistically, i.e. in that parameters of the type mentioned above are determined for a plurality of similar screw connections and these parameters are used for all subsequent screw connections of a similar type or the same type.

Preferably, the method is carried out separately for each individual screw connection. It is thus possible to individually take into account deviations in similar screw connection instances, yielding a very high-quality screw connection. The method can also be consequently used in a very flexible fashion. Since the method is able to adapt itself to the (individual) characteristics of an (individual) screw connection (in particular of an individual screw connection instance), it is possible to produce screw joints in rapid succession, even when they differ widely from one another.

For the drive unit of the screwdriver employed, it is possible to provide practically any type of drive unit that can be used industrially or in the craft sector. Preferably, the method is carried out in an automated fashion with the aid of an electric screwdriver control unit and/or an electric screwdriver drive unit regulating device. The screwdriver control unit and/or the screwdriver drive unit regulating device have/has sufficient resources and "intelligence" to self-sufficiently/autonomously carry out the method according to the invention anew, preferably for each individual screw connection.

Preferably, the duration of the tightening phase and/or a quantity that corresponds to it is qualitatively and/or quantitatively adjustable, in particular is qualitatively adjustable in steps. It is thus possible, for example, for the operator to adapt the behavior of the method according to the invention in accordance with his or her own ideas, requirements, constitution, physical condition, or preferences. For a trained, experienced, strong operator, it makes sense for the method to be carried out quickly, i.e. at a "hard" setting, in order to increase efficiency and output. A presetting of this kind can be used, for example, in—even indirectly—determining the acceleration interval and/or deceleration interval and/or starting speed or the entire characteristic, e.g. the regulating characteristic, of the method. For example, 2 to 10—in particular 5—stages can be provided for this; the first stage represents a slow, soft behavior with a comparatively low starting speed and/or a long acceleration interval and/or a likewise long deceleration interval, while the respective higher stages represent a correspondingly "harder" behavior.

In order to increase the reliability of the method according to the invention, after the screwing-in phase, the beginning of the tightening phase can be detected in particular by measuring the torque and, when it exceeds a predetermined threshold moment, the end of the screwing-in phase and the beginning of the tightening phase is detected; after the detection, preferably the method according to one embodiment of the present invention is carried out. The threshold moment can likewise be retrievably predefined and in fact, correspondingly carried out at the minimum speed, as above. Preferably, there is a "safety distance", i.e. a threshold offset, in relation to a usual torque during the screwing-in phase so that random changes, temporary resistances, or even erratic movements of the operator do not automatically result in the detection of a tightening phase.

In order to increase the efficiency of the method, the starting speed can be determined by taking into account a predetermined maximum speed, which is either device-dependent or is retrievably stored in a control unit and/or in a drive unit regulator of the screw driving tool.

The objects mentioned at the beginning and all of the above-mentioned advantages are also attained in that an electric screw driving tool, which is equipped with an integrated or separate drive unit regulator and/or an integrated or separate screw driving control unit, is embodied and/or configured and/or programmed for carrying out a method according to the present invention.

In particular, an electric screw driving tool of this kind has means for detecting the instantaneous torque exerted on the screw connection, the instantaneous rotation angle, or values that correspond to these instantaneous values. In addition, the screw driving tool and/or its drive unit regulator and/or its screw driving control unit have corresponding digital circuits, e.g. equipped with a DSP, a microcontroller, an FPGA, or the like and corresponding software and/or firmware that implements the method steps. Naturally, the upper limit of the acceleration, in other words the lower limit of the acceleration interval as well, is limited by means of the drive dynamics of the screw driving tool and is parameterized within the dynamic power limits.

The invention will be explained in greater detail in conjunction with the following figures.

DETAILED DESCRIPTION OF THE PREFERRED EMBODIMENTS

Figure 1A:
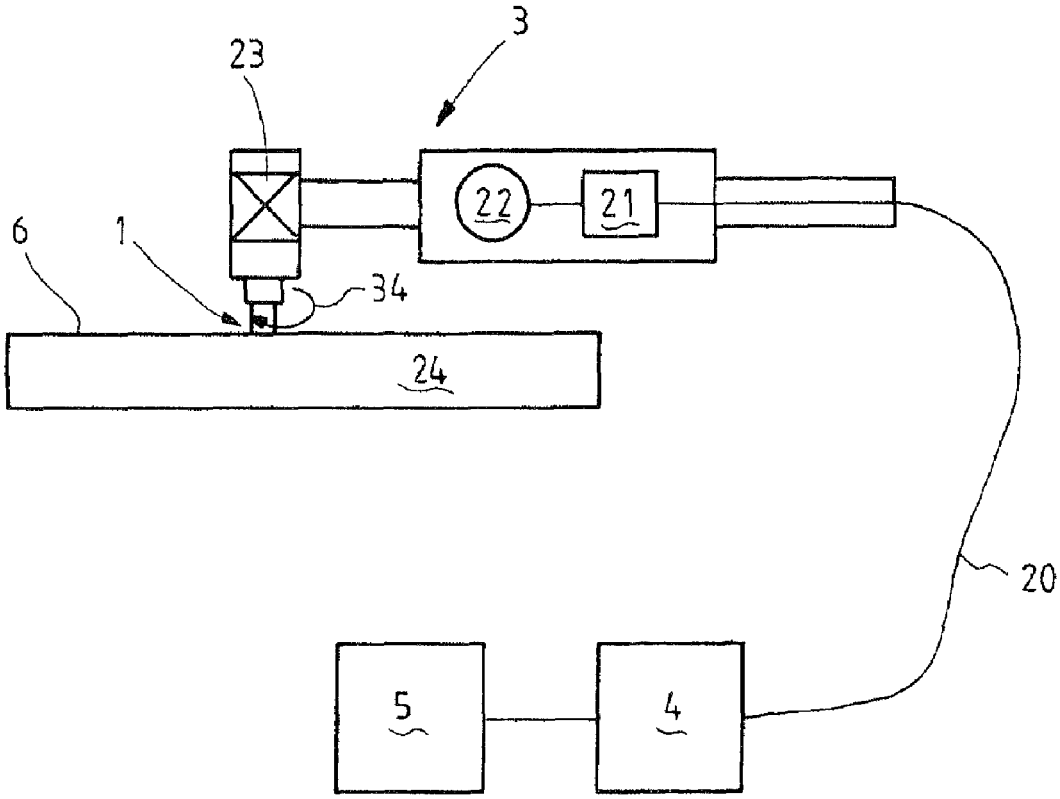
FIG. 1*a* is a schematic side view of an electric screw driving tool according to the present invention.

The depiction in all of the figures is merely intended to illustrate the broad outlines of how the invention functions and has therefore been kept very schematic; details and particulars have been partially omitted. Provided that nothing to the contrary is stated, all reference numerals apply equally to all of the figures.

FIG. 1*a* is a side view of an electric screwdriver 3 that is suitable for carrying out the method according to the invention. The electric screwdriver 3 is thus suitable for a method for screwing in and tightening a screw connection 1 (which is not visible in the figure and is covered, for example, by a socket of an electric screwdriver 3) to a predetermined tightening level (2 in FIG. 2). The screw connection 1 has a screw (not shown), which is screwed into a threaded screw hole (not shown) and is to be fastened in place there. The threaded hole is situated in a screw support 24 into which the screw is being screwed.

The electric screwdriver 3 has an electric motor 21 for driving it; the drive torque (not shown) of the electric motor 21 is transmitted to the output via a deflecting transmission 23 and from the output, is transmitted to the screw connection 3. The method according to the invention is particularly well suited for the angled screwdriver shown here. This will be illustrated further by the additional description.

The electric screwdriver also has a feedback or transducer 22, which detects the instantaneous angular position, e.g. of the drive shaft of the motor 21. The transducer can also—directly or indirectly—determine the angular position of the screw of the screw connection 1, i.e. in particular, directly determining the angular position of the drive shaft of the electric screwdriver. This transducer also makes it possible to detect the instantaneous torque that the output exerts on the screw connection 1. Such a means for detecting the instantaneous torque that the output exerts on the screw connection 1 is known from the prior art and is integrated into the electric screwdriver 3.

The supply of energy and the communication occur via a power and signal line 20. The electric screwdriver 3 uses this line 20 to communicate with a drive unit (regulator) 4 and/or with a control unit 5. The drive unit 4 can, for example, be a drive unit regulating device with an integrated inverter, which has an intermediate circuit DC voltage and converts it, e.g. by means of pulse width modulation, into the instantaneously set frequency signal for the regulated operation of the electric motor 21.

The electric screwdriver 3 and/or the drive unit regulator 4 communicate(s) with a screwdriver control unit 5. The screwdriver control unit 5 and drive unit regulator 4 can include means for electronic, digital data processing, e.g. a microprocessor, microcontroller, FPGA, or DSP, and/or other processor types. The screwdriver control unit 5 is used to control the screw driving process, e.g. to adjust overriding parameters such as the behavior of the electric screwdriver 3, etc.

Figure 1B:
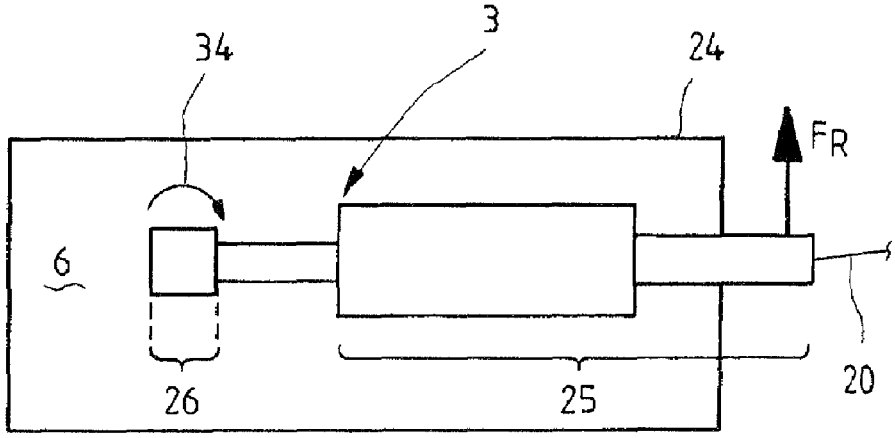
FIG. 1*b* is a top view of the electric screwdriver from FIG. 1.

The top view in FIG. 1*b* shows that the electric screwdriver 3 has a grip region 25 and a grip region/pressing region 26 by means of which the operator (not shown) can operate the electric screwdriver 3 with one hand (not shown) or with both hands (also not shown). In the depicted rotation direction 34 at the output of the electric screwdriver 3, a reaction force $F_R$ acts on the operator; as a rule, this force is found to be unpleasant and is for the most part to completely compensated for.

Figure 2:
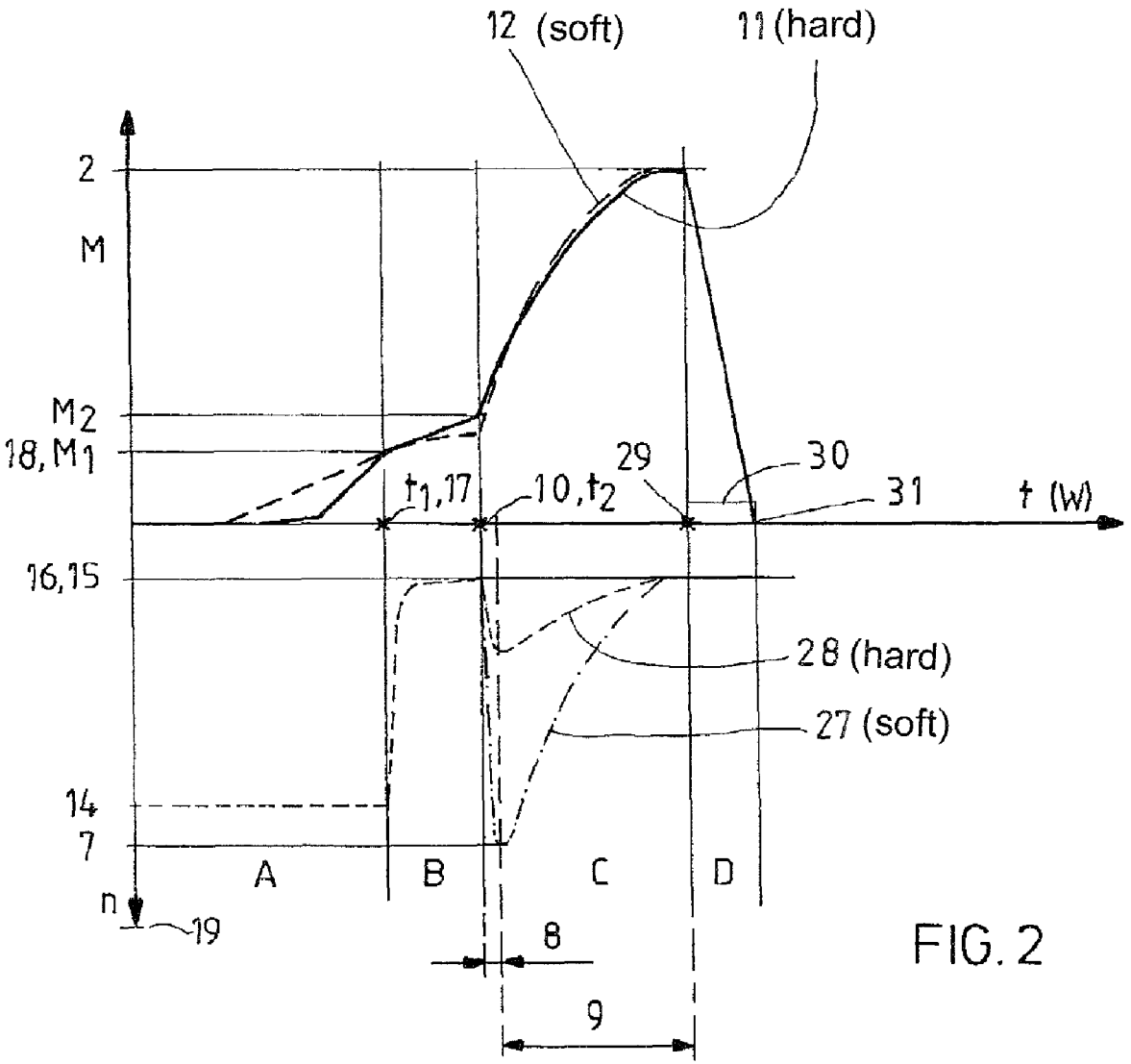
FIG. 2 is a very schematic graph depicting the torque/speed over time (in the labeling of the paragraphs, the angle is also given in parentheses, which is intended to indicate that the depiction can be at least partially or qualitatively or correspondingly consistent with the depiction over the angle)

In FIG. 2, a torque curve is very schematically plotted in the upper portion of the graph and a corresponding speed curve according to the invention, whose values increase toward the bottom, is plotted chronologically synchronous to it in the lower portion of the graph; the two curves are thus plotted in a chronologically synchronous fashion on the same time axis. The output of the electric screwdriver 3 rotates the screw of the screw connection 1 with a speed curve 14 during the screwing-in phase A. The speed 14 during the screwing-in phase A is practically constant; it can have slight fluctuations that arise due to irregularities in the screwing-in process, but such fluctuations are not depicted here for the sake of improved clarity.

Chronologically synchronous to this, the curve of the torque M is plotted in the upper portion of FIG. 2. The torque remains practically constant during the screwing-in phase and in this case, is set to approximately zero. Depending on the friction conditions in the threaded hole, however, particularly with self-tapping/thread-forming screws, this torque during the screwing-in phase A can also be somewhat higher than zero.

As soon as the screw head (not shown) of the screw connection 1 comes into contact with the bearing surface 6 of the screw connection 1, the torque increases because starting from this instant, the screw begins to exert a prestressing force. Until a threshold moment 18 is reached, the speed 14 remains practically unchanged. As soon as a threshold moment 18 is reached and detected, the speed 14 is reduced to a reduced speed 15. The threshold moment 18 is selected to be large enough that in a usual curve or in all conceivable curves, the torque increases monotonously, particularly in a very monotonous fashion, as soon as the threshold moment is detected. This yields a reliable measurement of the screw joint hardness that can also be used in a predictive fashion.

This can be considered the "beginning" 17 of the tightening phase B-C-D. Two curves 11, 12 of the torque M are shown in the tightening phase B-C-D. The curve 11 corresponds to a "hard" screw joint and the curve 12 corresponds to a "soft" screw joint. It is clear that in the hard curve 11, at the end of the screwing-in phase A, the torque rises in a comparatively more rapid fashion; this is also true for the measurement phase B. Further discussion below will center essentially on consideration of the "hard" curve 11.

At the reduced speed 15 (which in the examples shown, corresponds to a minimum speed 16 that can, for example, be device-dependent), measurements of the torque and the angle are carried out in order to determine the screw joint hardness. It is evident from the upper portion of FIG. 2 that at the reduced speed 15 and also during the decrease in the instantaneous speed to the speed 15, the torque rises in a very monotonous fashion. Between or at the two times t1 and t2, the instantaneous torque M1 and M2 and the current angle W1 and W2 are measured in order, in the way mentioned further above, to obtain the screw joint hardness or an evaluation quantity for the screw joint hardness. Because of the reduced speed 15, the screw of the screw connection 1 has continued to rotate only to an insignificant degree during the measurement phase B and in particular, the torque has increased only to insignificant degree.

The end of the measurement phase B is followed by the beginning 10 of the acceleration. This point is already part of the tightening phase B-C-D. The synchronous speed curve is plotted in FIG. 2 with values increasing toward the bottom, in the form of a dashed curve 28 (corresponding to the "soft" dot-and-dash curve 27). Within the acceleration interval 8, the speed of the screw driving tool 3 is increased to a starting speed 7. As is clear from FIG. 2, the increase occurs within a very short time interval. The time portion of the acceleration interval is shorter than a usual human reaction time so that during the time portion, the reaction moment and the reaction force $F_R$ are braced against by the mass of the system.

After the acceleration interval 8, the speed is reduced during a deceleration interval 9 until the achievement of the predetermined tightening level 2. It is clear that the acceleration interval 8 and the deceleration interval 9, taken together, make up the predominant portion of the total tightening phase B-C-D. It should be noted here that neither the orders of magnitude and ratios of the coordinates, nor the orders of magnitude and ratios of the time intervals, angles, speeds, and torques, nor the ratios of all of the depicted quantities to one another have to correspond to the actual quantity ratios, both absolutely and in relation to one another, i.e. relatively, but they can do so. Instead, the depiction is to be understood as very schematic. Thus, for example, the depicted acceleration interval 8 can be even more significantly brief in comparison to the depicted deceleration interval 9 than is shown. The depicted representation is only schematic and is intended merely to illustrate the invention in a simplified, comprehensible fashion.

The deceleration interval 9 by itself makes up the predominant portion of the total tightening phase B-C-D, particularly with regard to the traveled rotation angle of the screw connection 1. It is evident here that the acceleration interval 8 is significantly shorter than the deceleration interval 9. Practically immediately (i.e. within the dynamics of the involved components) at the beginning of phase C, the speed is increased in a steeply rising fashion (e.g. progressively at the beginning). It increases until it reaches a starting speed (not shown for the "hard" speed curve 28, in accordance with the depicted (local) maximum, merely indicated as the starting speed 7 by means of the peak for the "soft" curve 27). The increase in the speed is thus very sharp at the beginning of the acceleration interval 8 and then transitions into the maximum, the respective starting speed (e.g. 7 for the soft curve 27). Beginning at the starting speed (e.g. 7), the speed then decreases, e.g. in a degressive fashion, during the deceleration interval 9. The degressive curve 28 or 27 results from the regulating dynamics and the parameterization, e.g. of the PI regulator, for example taking into account the minimum speed 16 that should be set after the deceleration in a soft and preferably smooth transition, i.e. particularly with a low amount of jolting or with practically no jolting.

The deceleration interval 9 and the entire resulting speed curve 28 or 27 are embodied so that, preferably taking into account (the predictive character of) the screw joint hardness, the minimum speed 16 is regulated or assumed with a smooth, gradual, preferably almost steady transition. On the whole, taking into account the screw joint hardness measured during the measurement phase, there can be virtually the same torque curve 11, 12 for different screw joint hardnesses, at least during the phase C or the tightening phase B-C-D. This is because of the predictive character of the screw joint hardness, e.g. taken into account in the regulator parameterization. This is evident in the upper portion of FIG. 2. The curves 11, 12 are virtually equivalent so that the worker either does not notice different screw joint hardnesses at all or only notices them to a limited degree.

The minimum speed 16 and the reduced speed 15 that is assumed during the measurement phase B are the same in the exemplary embodiment shown; in reality, however, it is also entirely conceivable for them to be different. Likewise, all of the depicted speed constants and all of the depicted torque constants for the torque curves and speed curves 11, 12, 27, 28 can be the same or different. This also applies to the depicted maximum speed 19, which, merely for the sake of completeness, is indicated in a more symbolic fashion as the lower end of the speed axis n.

The explanations above apply in corresponding fashion to the "soft" screw joint and its torque curve 12 and speed curve 27.

Finally, after the minimum speed 16 is reached, at the beginning 29 of the reversal, the speed is reversed to relieve the stress on the screw connection 1 and screw driving tool and to permit a simple detachment of the screw driving tool, which may possibly have become jammed or twisted in relation to the screw. Preferably a low reversing speed 30 in the opposite direction is begun here; this, too, is the same for the depicted "hard" and "soft" curves. At the end of the (brief) reversing procedure, the end 31 of the tightening phase B-C-D is reached.

Figure 3:
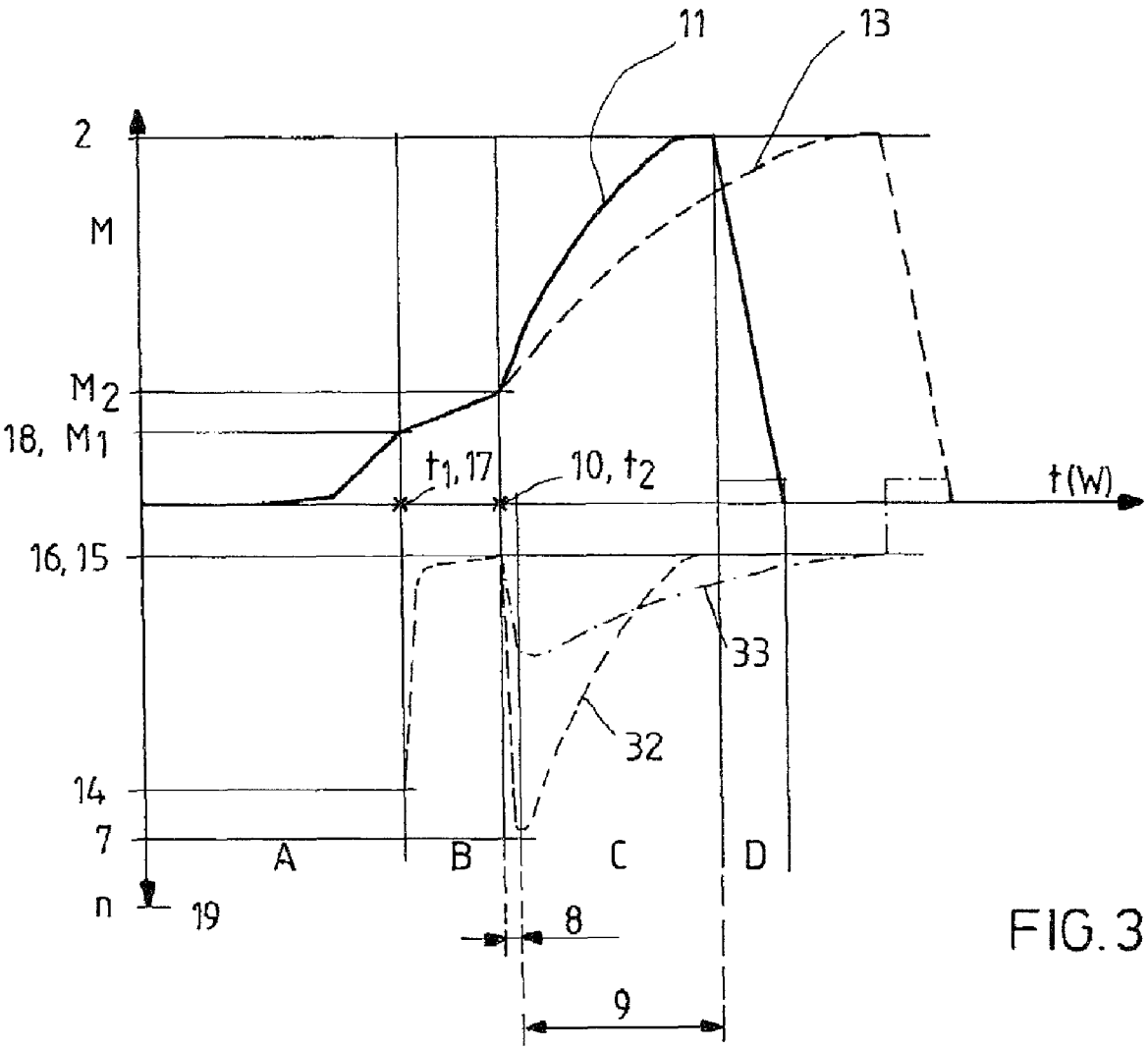
FIG. 3 is also a very schematic graph depicting other torque/speed curves, likewise plotted over time/angle.

Finally, FIG. 3 shows that the duration of the tightening phase B-C-D can be qualitatively and/or quantitatively adjusted. FIG. 3 shows the curves 11 and 13, which correspond to curves 32 and 33. The curves 11, 32 show a preset "fast" screw driving procedure, while the curves 13, 33 show a set "slow" screw driving procedure, in particular with both curves at the same or practically the same screw joint hardness. The two different curves 11, 32 and 13, 33 correspond to different stages of a presetting; the curves 11, 32 correspond to a "fast" or "hard" setting while the curves 13, 33 correspond to a "slow" or "soft" setting. The curves 11, 32; 13, 33 of differing "hardnesses" differ primarily and practically exclusively in the duration of the respective tightening phase B-C-D and particularly in the length of the respective phase C and especially of phase D. In the slow curve 13, 33 (in particular only) the phase C is longer than in the fast curve 11, 32, with acceleration interval 8 being approximately equal.

REFERENCE NUMERAL LIST

1 screw connection
2 predetermined tightening level
3 electrical screwdriver
4 drive unit regulator
5 screwdriver control unit
6 bearing surface of the screw connection
7 starting speed
8 acceleration interval
9 deceleration interval
10 beginning of acceleration
11 torque curve during tightening phase
12 torque curve during tightening phase
13 torque curve during tightening phase
14 speed during screwing-in phase
15 reduced speed
16 minimum speed
17 beginning of tightening phase
18 threshold moment
19 maximum speed
20 power and/or signal lines
21 electric motor
22 feedback/transducer
23 deflecting transmission
24 screw support
25 grip region of electric screwdriver
26 grip region/pressing region of electric screwdriver
27 speed curve (soft screw joint)
28 speed curve (hard screw joint)
29 beginning of reversal/backward rotation
30 reversing speed
31 end of tightening phase
32 speed curve "fast" screw driving procedure
33 speed curve "slow" screw driving procedure
34 rotation direction at output
M torque
$F_R$ reaction force
t time
W angle
A screwing-in phase
B sample phase/measurement phase
C acceleration and deceleration phase
D reverse phase

What is claimed is:

1. A method for screwing in and tightening a screw connection (1) to a predetermined tightening level (2), comprising the following steps:

providing a hand-held screw driving tool (3) with a regulated drive unit (4) or control functionality or both;

performing a screwing-in phase (A);

after said screwing-in phase (A), performing a tightening phase (B-C-D), wherein during said tightening phase (B-C-D), a screw head rests against a bearing surface (6) of the screw connection (1);

increasing a speed (N) of the screw driving tool (3) during the tightening phase (B-C-D) within an acceleration interval (8) to a starting speed (7) for the tightening phase (B-C-D), wherein a quantity corresponding to said acceleration interval is selected from the group consisting of a starting speed, a maximum speed, an instantaneous acceleration, or a limit acceleration, wherein said quantity corresponding to said acceleration interval further is actively changeable, predeterminable, controllable, regulatable, or any combination thereof, and wherein said quantity corresponding to said acceleration interval is independent of individually determined screw joint properties;

decreasing the speed (N) of the screw driving tool (3) within a deceleration interval (9) before achievement or until achievement of the predetermined tightening level (2), wherein the acceleration interval (8) and the deceleration interval (9), taken together, make up a predominant portion of the tightening phase (B-C-D) with regard to a traveled rotation angle (W) of the screw connection (1), and wherein the acceleration interval (8) is shorter than the deceleration interval (9).

2. The method as recited in claim 1, wherein a time portion of the acceleration interval (8) extends from the beginning (10) of the acceleration to achievement of between 20% and under 100% of the starting speed (7) or corresponds to the entire acceleration interval (8), wherein said time portion is shorter than a usual human reaction time required to compensate for, absorb, or both compensate and absorb the reaction force ($F_R$) acting on the operator so that during the time portion, a reaction moment is essentially braced against by means of a reaction acceleration of a mass of the screw driving tool (3) that is inertially encumbered by additionally taking into account an average inertially encumbered holding hand, an average inertially encumbered holding arm, or both.

3. The method as recited in claim 1, wherein a time portion of the acceleration interval (8) extends from a beginning (10) of the acceleration to achievement of between 20% and under 100% of the starting speed or corresponds to the entire acceleration interval (8), wherein said time portion amounts to 20 to 200 ms.

4. The method as recited in claim 3, wherein said time portion amounts to 50 to 150 ms.

5. The method as recited in claim 3, wherein said time portion amounts to 70 to 100 ms.

6. The method as recited in claim 3, wherein said time portion amounts to 80 to 85 ms.

7. The method as recited in claim 1, wherein the deceleration interval (9) alone makes up the predominant portion of the total tightening phase (B-C-D) with regard to the traveled rotation angle (W) of the screw connection (1).

8. The method as recited in claim 1, wherein during the tightening phase (B-C-D), a torque curve (11, 12, 13) that is practically characteristic for the screw connection (1) and that is essentially described by a screw joint hardness is present in the tightening phase (B-C-D), wherein the screw joint hardness is determined in a starting phase (B) of the tightening phase (B-C-D) by measuring at least one measurement quantity that is relevant to the screw joint hardness, wherein a speed (15) is set during the starting phase (B) for said measuring at least one measurement quantity, wherein said speed (15) that is set is reduced in comparison to an average speed (14) during the screwing-in phase (A).

9. The method as recited in claim 8, wherein the screw joint hardness is used in a determination of the acceleration interval (8), deceleration interval (9), starting speed (7), or any combination thereof.

10. The method as recited in claim 8, wherein the screw joint hardness is used in an determination of a curve of the deceleration to avoid or minimize a torque lag time after achievement of the predetermined tightening level (2).

11. The method as recited in claim 10, wherein the screw joint hardness is used in an automatic parameterization of a PI regulating system, which is provided for setting the predetermined tightening level (2).

12. The method as recited in claim 8, further comprising the steps of detecting during the starting phase (B), instantaneous values including an instantaneous torque ($M_1$, $M_2$) and instantaneous angle ($W_1$, $W_2$) at the two different times ($t_1$, $t_2$, e.g. $t_2>t_1$), determining an evaluation quantity (h) that represents the screw joint hardness based on said instantaneous values, and using said evaluation quantity (h), $$\text{where } h = \frac{(M_2 - M_1)}{(W_2 - W_1)}.$$

13. The method as recited in claim 8, wherein during the starting phase (B) of the tightening phase (B-C-D), a speed (15) occurs that is reduced in relation to the speed (14) during the screwing-in process (14) and is a practically constant speed (15), wherein a resulting torque (M) during the starting phase (B) increases monotonously in a very monotonous fashion, and wherein the torque/speed ratio is representative for the screw joint hardness.

14. The method as recited in claim 1, wherein within the deceleration interval (9), a deceleration to a predetermined minimum speed (16) takes place, wherein said minimum speed is retrievably stored in a control unit (5) or in a drive unit (4) of the screw driving tool (3).

15. The method as recited in claim 1, further comprising performing the method separately for each individual screw connection (1).

16. The method as recited in claim 1, further comprising performing the method in an automated fashion with the aid of an electric screwdriver control unit (5), an electric screwdriver drive unit regulating device (4), or both.

17. The method as recited in claim 1, wherein a duration of the tightening phase (B-C-D) or a quantity that corresponds to the duration is qualitatively adjustable in steps, quantitatively adjustable, or both.

18. The method as recited in claim 1, further comprising the steps of detecting a beginning (17) of the tightening phase (B-C-D) after the screwing-in phase (A) by measuring torque (M) when it exceeds a predetermined threshold moment (18), and performing said method after the detection of the beginning (17) of the tightening phase (B-C-D).

19. The method as recited in claim 1, wherein the starting speed (7) is determined by taking into account a maximum speed (19), which is either device-dependent or is retrievably stored in a control unit (5) of the screw driving tool (3), in a drive unit regulator (4) of the screw driving tool (3), or in both.

20. An electric screw driving tool (3), comprising:

a screw driving control unit (5) having a microcontroller, said microcontroller having program code for causing performance of a screwing-in phase (A); code for causing performance of a tightening phase (B-C-D), wherein during said tightening phase (B-C-D), a screw head rests against a bearing surface (6) of the screw connection (1); code for causing an increase in a speed (N) of the screw driving tool (3) during the tightening phase (B-C-D) within an acceleration interval (8) to a starting speed (7) for the tightening phase (B-C-D), wherein a quantity corresponding to said acceleration interval is selected from the group consisting of a starting speed, a maximum speed, an instantaneous acceleration, or a limit acceleration, wherein said quantity corresponding to said acceleration interval further is actively changeable, predeterminable, controllable, regulatable, or any combination thereof, and wherein said quantity corresponding to said acceleration interval is independent of individually determined screw joint properties; and code for causing a decrease in the speed (N) of the screw driving tool (3) within a deceleration interval (9) before achievement or until achievement of the predetermined tightening level (2), wherein the acceleration interval (8) and the deceleration interval (9), taken together, make up a predominant portion of the tightening phase (B-C-D) with regard to a traveled rotation angle (W) of the screw connection (1), and wherein the acceleration interval (8) is shorter than the deceleration interval (9).

* * * * *